US010709225B2

(12) United States Patent
Cho et al.

(10) Patent No.: US 10,709,225 B2
(45) Date of Patent: Jul. 14, 2020

(54) METHOD FOR PRODUCING COSMETIC PUFF USING MEMBRANE FILM, AND COSMETIC PUFF PRODUCING USING SAME

(71) Applicant: COSMECCA KOREA CO., LTD., Chungcheongbuk-do (KR)

(72) Inventors: Hyun Dae Cho, Chungcheongbuk-do (KR); Hyoun Cheol An, Chungcheongbuk-do (KR); Byoung Moon Kim, Gyeonggi-do (KR)

(73) Assignee: COSMECCA KOREA CO., LTD., Chungcheongbuk-Do (KR)

( * ) Notice: Subject to any disclaimer, the term of this patent is extended or adjusted under 35 U.S.C. 154(b) by 0 days.

(21) Appl. No.: 16/060,050

(22) PCT Filed: Dec. 12, 2016

(86) PCT No.: PCT/KR2016/014510
§ 371 (c)(1),
(2) Date: Jun. 7, 2018

(87) PCT Pub. No.: WO2017/105045
PCT Pub. Date: Jun. 22, 2017

(65) Prior Publication Data

US 2018/0360194 A1 Dec. 20, 2018

(30) Foreign Application Priority Data

Dec. 14, 2015 (KR) ..... 10-2015-0178052

(51) Int. Cl.
*B05C 21/00* (2006.01)
*A45D 37/00* (2006.01)
(Continued)

(52) U.S. Cl.
CPC ..... *A45D 37/00* (2013.01); *A45D 34/00* (2013.01); *A45D 34/04* (2013.01);
(Continued)

(58) Field of Classification Search
CPC ..... A45D 34/04; A45D 37/00; A45D 2200/1018; A45D 2200/1036;
(Continued)

(56) References Cited

U.S. PATENT DOCUMENTS 6,006,761 A * 12/1999 Meledandri ..... A45D 33/34 132/317
7,604,623 B2 * 10/2009 Brunner ..... C11D 17/041 604/383
(Continued)

FOREIGN PATENT DOCUMENTS

KR 20080042099 A 5/2008
KR 20100011637 12/2010
(Continued)

OTHER PUBLICATIONS

International Search Report in PCT/KR2016/014510, dated Apr. 10, 2017.

*Primary Examiner* — Jennifer C Chiang
(74) *Attorney, Agent, or Firm* — Bacon & Thomas, PLLC

(57) ABSTRACT

A method for producing a cosmetic puff using a membrane film and a cosmetic puff, the cosmetic puff being produced through the steps of: forming a liquid cosmetic material storage part of which an inner skin has at least one surface thereof made of a membrane film; filling a liquid cosmetic material into the liquid cosmetic storage part; covering the entire outer surface of the inner skin or the inner skin top surface with a porous cushion material; and covering the outer surface of the inner skin or the cushion material with an outer skin. The cosmetic puff allows a liquid cosmetic
(Continued)

material to be discharged to the outside of the puff merely by pressure during use, provides the effect of moisturizing and astringing skin, thereby prevents the skin from becoming dry, and, at the same time, has the effect of preventing outside contents or bacteria from penetrating the inside.

16 Claims, 6 Drawing Sheets

(51) Int. Cl.
*A45D 34/04* (2006.01)
*A45D 34/00* (2006.01)

(52) U.S. Cl.
CPC ..... *A45D 2200/1018* (2013.01); *A45D 2200/1036* (2013.01); *A45D 2200/1045* (2013.01); *A45D 2200/1054* (2013.01); *A45D 2200/1063* (2013.01)

(58) Field of Classification Search
CPC .... A45D 2200/1045; A45D 2200/1054; A45D 2200/1063
USPC ..... 401/196
See application file for complete search history.

(56) References Cited

U.S. PATENT DOCUMENTS

| | | | | |
|---|---|---|---|---|
| 2006/0110206 | A1* | 5/2006 | Scribner | A45D 34/04 401/134 |
| 2008/0025787 | A1* | 1/2008 | Shea | A45D 34/04 401/265 |
| 2018/0027941 | A1* | 2/2018 | Choi | A45D 33/34 |
| 2018/0255904 | A1* | 9/2018 | Li | A45D 34/04 |

FOREIGN PATENT DOCUMENTS

| | | | |
|---|---|---|---|
| KR | 101276325 | B1 | 6/2013 |
| KR | 200472436 | Y1 | 4/2014 |
| KR | 101385652 | B1 | 5/2014 |
| KR | 200477062 | Y1 | 5/2015 |

* cited by examiner

METHOD FOR PRODUCING COSMETIC PUFF USING MEMBRANE FILM, AND COSMETIC PUFF PRODUCING USING SAME

FIELD OF THE INVENTION

The present invention relates to a cosmetic puff using a membrane film and, more particularly, to a method for producing a cosmetic puff using a membrane film and the cosmetic puff produced using the same, wherein the method allows a liquid cosmetic material to be discharged to the outside of the puff merely by pressure during use such that the liquid cosmetic material can provide the effect of moisturizing and astringing the skin, thereby prevents the skin from becoming dry and, at the same time, prevents contents or bacteria outside the puff from penetrating into the inside of the puff when the puff absorbs moisturizing components of the skin by producing a puff in which a liquid cosmetic material such an essence, cosmetic water, oil or others is embedded using a membrane film functioning as a filter.

BACKGROUND OF THE INVENTION

In general, cosmetic materials are divided into basic cosmetics, make-up cosmetics, and so on according to functions of the cosmetic materials, and such cosmetic materials are divided into cream, powder and liquid states according to states of the cosmetic materials and are each stored in a container suitable to each of the states.

At this time, a cosmetic puff is usually used to evenly spread the color cosmetic material on a facial or skin region to be made-up without agglomeration of the color cosmetic material and closely adhesively apply the color cosmetic material onto the facial or skin region by putting a color cosmetic material such as a foundation used as a make-up base on the cosmetic puff.

Such puff as a pad type puff which is made of cotton, sponge, expanded NBR (nitrile butadiene rubber), polyester, nylon, acryl, acetate or the like, and which is elastic, is generally received and stored along with a cosmetic container. Therefore, when putting on make-up using the puff received in the cosmetic container, the puff is taken out of the cosmetic container having the puff received therein, and a bottom surface of the puff is coated with the cosmetic material to use the puff coated with the cosmetic material.

However, when the puff is coated with the cosmetic material to evenly spread and apply the puff coated with the cosmetic material on the skin, the puff tends to make the skin dry by absorbing the cosmetic material and moisturizing components of the skin.

Further, the puff is not coated well with the cosmetic material as oil or moisture contained in the powder is evaporated into the atmosphere when a cosmetic material formed in the form of a powder is exposed to the atmosphere for a long time. Therefore, there is also a problem that the cosmetic material cannot be uniformly applied onto the skin.

Thus, a puff is disclosed in Korean utility model registration No. 20-0456829 to solve the above-mentioned problems, the puff including a liquid storage part which stores liquid within a cushion body, and an outlet for discharging liquid towards an outer skin and a leakage preventing film which are formed on one side of the liquid storage part, wherein the puff is formed such that the liquid is discharged through the outlet according to pressurization of the liquid storage part by forming the liquid storage part of any one of rubber or synthetic resin having elastic restoring force.

However, structure of the outlet and the leakage preventing film of such a design has a disadvantage that liquid of the inside cannot be smoothly discharged, and a screw structure which complements the disadvantage and controls opening and closing of the outlet is complicated. Therefore, there are problems that the puff is not economical and makes a user feel inconvenience when considering that the puff is an easily replaceable substitute.

Further, the puff has a disadvantage that it cannot prevent bacteria from the outside through a puff portion wetted with the liquid cosmetic of the inside from being parasitized on the puff or penetrated into the liquid storage part of the inside.

PRIOR ART DOCUMENT

Patent Document

Korean utility model registration No. 20-0456829

SUMMARY OF THE INVENTION

The present invention has been conceived to solve the foregoing problems, and the purpose of the present invention is to provide a method for producing a cosmetic puff using a membrane film and the cosmetic puff produced using the same, wherein the method allows a liquid cosmetic material to be discharged to the outside of the puff merely by pressure during use, provides the effect of moisturizing and astringing the skin, thereby prevents the skin from becoming dry and, at the same time, prevents contents or bacteria of the outside from penetrating into the inside when the puff absorbs moisturizing components of the skin by producing a puff in which a liquid cosmetic material such an essence, cosmetic water, oil or the like is embedded using a membrane film functioning as a filter.

In an aspect, a cosmetic puff produced using a membrane film according to the present invention is provided to solve the foregoing problems, the cosmetic puff including:

an inner skin 10 of which at least one surface forms a liquid cosmetic material storage part made of a membrane film;

a porous cushion material 20 which entirely or partially covers the outer surface of the inner skin 10;

an outer skin 30 which covers the inner skin 10 or the cushion material 20 to block penetration of an external makeup cosmetic material or external bacteria;

a liquid cosmetic material 40 which is stored in the liquid cosmetic material storage part; and a coating film 50 which is coated on a portion of the inner side of the inner skin 10.

Further, in the cosmetic puff produced using the membrane film according to the present invention, the inner skin 10 is formed to discharge a stored liquid cosmetic material to the outside through the membrane film by a predetermined pressurization force F.

Further, in the cosmetic puff produced using the membrane film according to the present invention, the membrane film is made of a hydrophilic or hydrophobic material.

Further, in the cosmetic puff produced using the membrane film according to the present invention, the membrane film includes any one selected from regenerated cellulose, nitrocellulose, cellulose acetate, polyvinyl alcohol, polyamide, glass and aluminum oxide (alumina) as the hydrophilic material.

Further, in the cosmetic puff produced using the membrane film according to the present invention, the membrane film made of the hydrophilic material has a thickness of 0.01 to 0.24 mm.

Further, in the cosmetic puff produced using the membrane film according to the present invention, the membrane film made of the hydrophilic material has an air permeability of 0.1 to 1.2 cfm.

Further, in the cosmetic puff produced using the membrane film according to the present invention, the membrane film includes, as the hydrophobic material, any one selected from polyethylene, polysulfone, polystyrene, polypropylene, polyethylene terephthalate (PET), polyvinylidene fluoride (PVDF), polytetrafluoroethylene (PTFE), polyvinyl chloride, polyester, acetate, triacetate, polymethyl methacrylate (PMMA), and nylon.

Further, in the cosmetic puff produced using the membrane film according to the present invention, the membrane film made of the hydrophobic material has a thickness of 0.001 to 0.02 mm.

Further, in the cosmetic puff produced using the membrane film according to the present invention, the membrane film made of the hydrophobic material has an air permeability of 0.1 to 1.4 cfm.

Further, in the cosmetic puff produced using the membrane film according to the present invention, the membrane film has a pore size of 0.025 to 0.2 μm.

Further, in the cosmetic puff produced using the membrane film according to the present invention, the inner skin 10 is divided into an inner skin top surface 10*a* and an inner skin bottom surface 10*b*, the inner skin top surface 10*a* is formed of a membrane film, and the inner skin bottom surface 10*b*, as a surface corresponding to a surface which is pressurized by one's fingers, is obtained by forming the coating film 50 on an inner surface of the inner skin bottom surface 10*b* to perform a waterproof coating treatment on the inner skin bottom surface 10*b*, or forming the inner skin bottom surface 10*b* itself of a water proof material such that the stored liquid cosmetic material is not discharged towards the fingers.

Further, in the cosmetic puff produced using the membrane film according to the present invention, the outer skin 30 is made of Rubycell material or NBR (Nitrile Butadiene Rubber) material through which the liquid cosmetic material passes, and which blocks penetration of the makeup cosmetic material or bacteria from the outside.

Further, in the cosmetic puff produced using the membrane film according to the present invention, the liquid cosmetic material 40 stored in the liquid cosmetic material storage part includes an essence or cosmetic water which is capable of giving a moisturizing effect to the skin by supplying moisture and nutrition to the skin, vegetable oil or animal oil which is pure to the skin, or mixtures thereof.

In other aspect, a cosmetic puff produced using a membrane film according to the present invention is provided, the cosmetic puff including:

an inner skin top surface 10*a* formed of the membrane film and a lower outer skin 30*b* coated with the coating film 50 which form the liquid cosmetic material storage part;

a porous upper cushion material 20*a* which covers an outer surface of the inner skin top surface 10*a;* an upper outer skin 30*a* which covers the upper cushion material 20*a*; and a liquid cosmetic material 40 which is stored in the liquid cosmetic material storage part.

In other aspect, a cosmetic puff produced using the membrane film according to the present invention is provided, the cosmetic puff including:

an inner skin top surface 10*a* formed of the membrane film and a lower outer skin 30*b* coated with the coating film 50 which form the liquid cosmetic material storage part;

an upper outer skin 30*a* which covers the outer surface of the inner skin top surface 10*a*; and a liquid cosmetic material 40 which is stored in the liquid cosmetic material storage part.

Furthermore, a method for producing a cosmetic puff using a membrane film according to the present invention comprises the steps of:

(S1) forming a liquid cosmetic material storage part of which an inner skin 10 has at least one surface thereof made of a membrane film;

(S2) filling a liquid cosmetic material into the liquid cosmetic storage part;

(S3) covering an entire outer surface of the inner skin 10 or the inner skin top surface 10*a* with the porous cushion material 20; and (S4) covering the outer surface of the inner skin 10 or the cushion material 20 with the outer skin 30.

Further, in a method for producing a cosmetic puff using a membrane film according to the present invention, the membrane film of the inner skin 10 discharges the stored liquid cosmetic material to the outside by the predetermined pressurization force F, and the outer skin 30 has the liquid cosmetic material passed therethrough, and blocks penetration of the makeup cosmetic material or bacteria from the outside.

The cosmetic puff produced using the membrane film of the present invention allows a liquid cosmetic material such an essence, cosmetic water, oil or the like to be discharged to the outside of the puff merely by pressure during use such that the liquid cosmetic material can provide the effect of moisturizing and astringing the skin, thereby prevents the skin from becoming dry and, at the same time, prevents contents or bacteria of outside the puff from penetrating into the inside of the puff.

Specifically, the cosmetic puff has effects of helping the makeup cosmetic material coated on the outer skin to be coated on facial skin more evenly and closely adhesively and enabling bacteria and so on penetrated from the outside to be primarily blocked by using an outer skin made of material which has the liquid cosmetic material passed therethrough, and which blocks penetration of the makeup cosmetic material, bacteria and so on from the outside.

Further, the cosmetic puff also has an effect of preventing the makeup cosmetic material, bacteria and so on from being penetrated into the liquid cosmetic material storage part by a membrane film which is provided at an inner side of the outer skin and has a relatively small pore size compared to that of the makeup cosmetic material, bacteria or the like although the makeup cosmetic material, bacteria or the like is penetrated into the outer skin depending on the material of the outer skin used.

Figure 5:
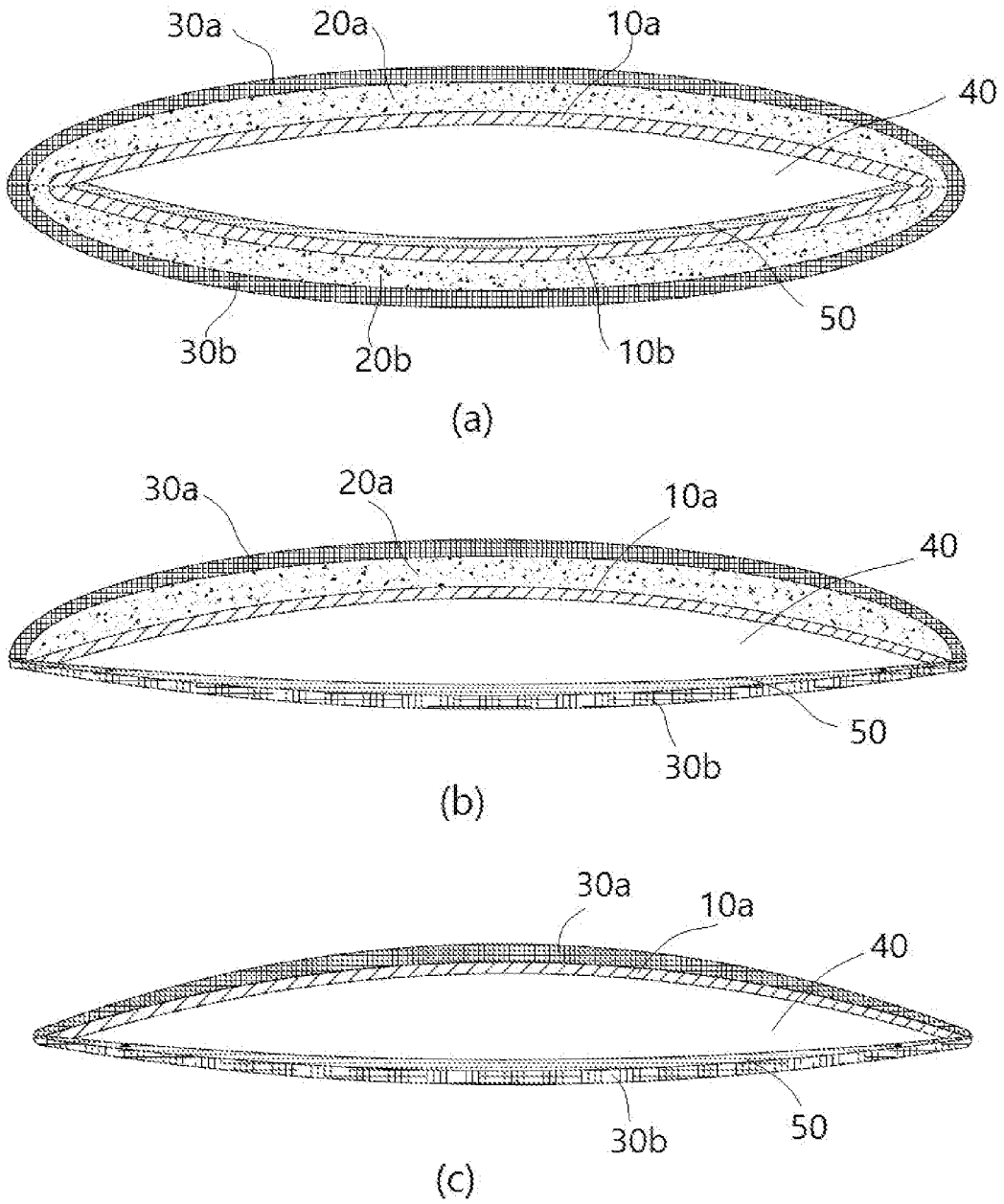

(a), (b) and (c) of FIG. 5 are cross-sectional views exemplifying an exemplary embodiment and other embodiments of the cosmetic puff using the membrane film according to the present invention.

Figure 6:
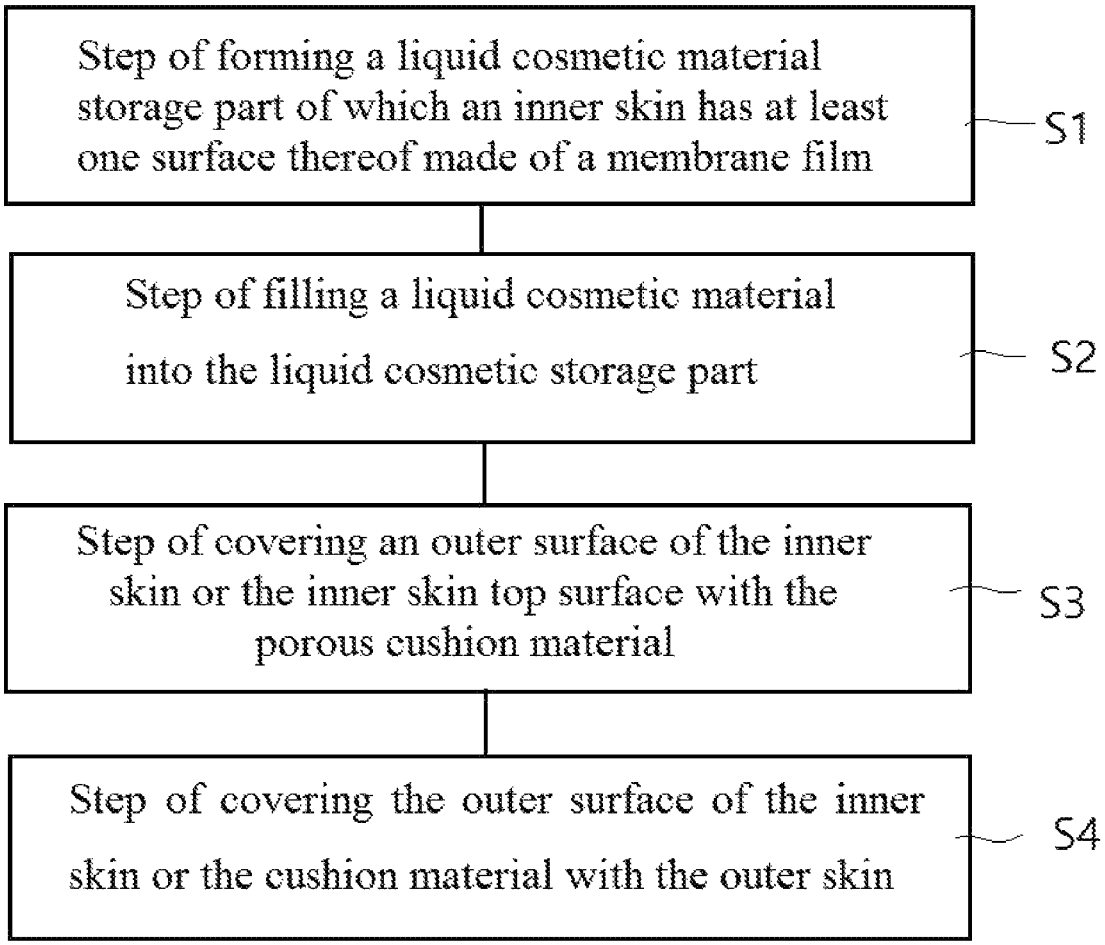

FIG. 6 is a production flow chart of the cosmetic puff using the membrane film according to the present invention.

DETAILED DESCRIPTION OF THE INVENTION

Hereinafter, an exemplary embodiment of the present invention will be described in detail with reference to the accompanying drawings.

Figure 1:
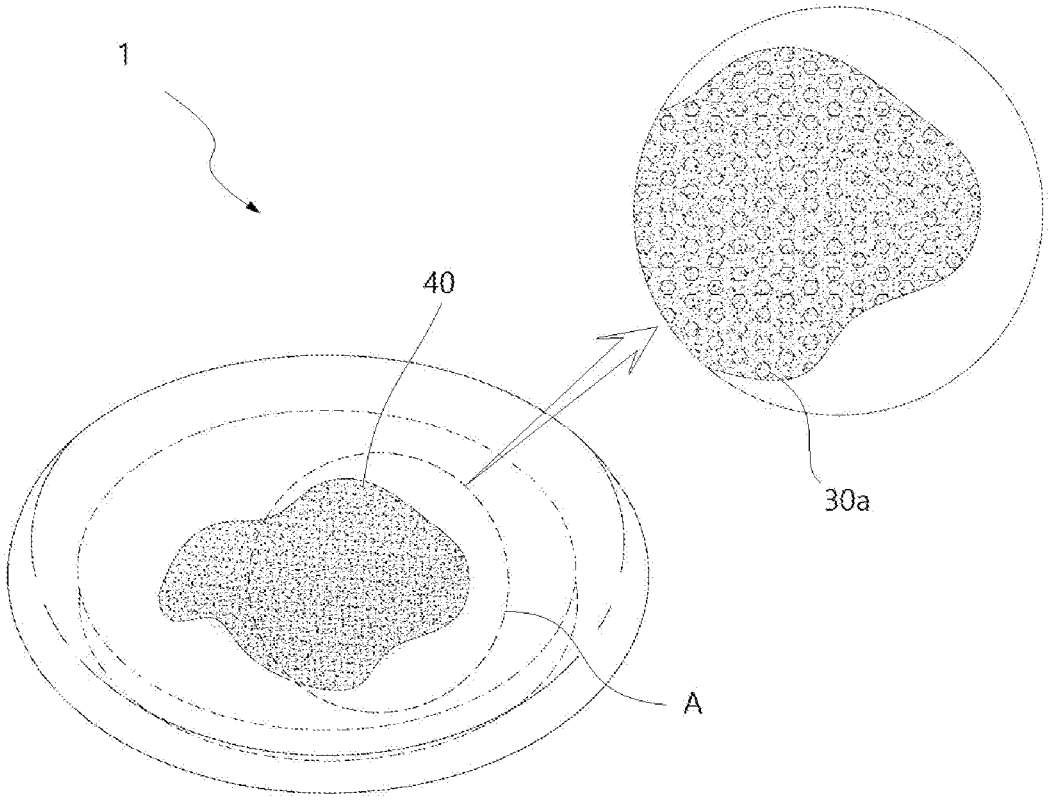
FIG. 1, as a perspective view showing a cosmetic puff using a membrane film according to the present invention, is a drawing briefly showing a state that the outer skin is moistened as the liquid cosmetic material of the storage part is discharged to the outside.
Figure 2:
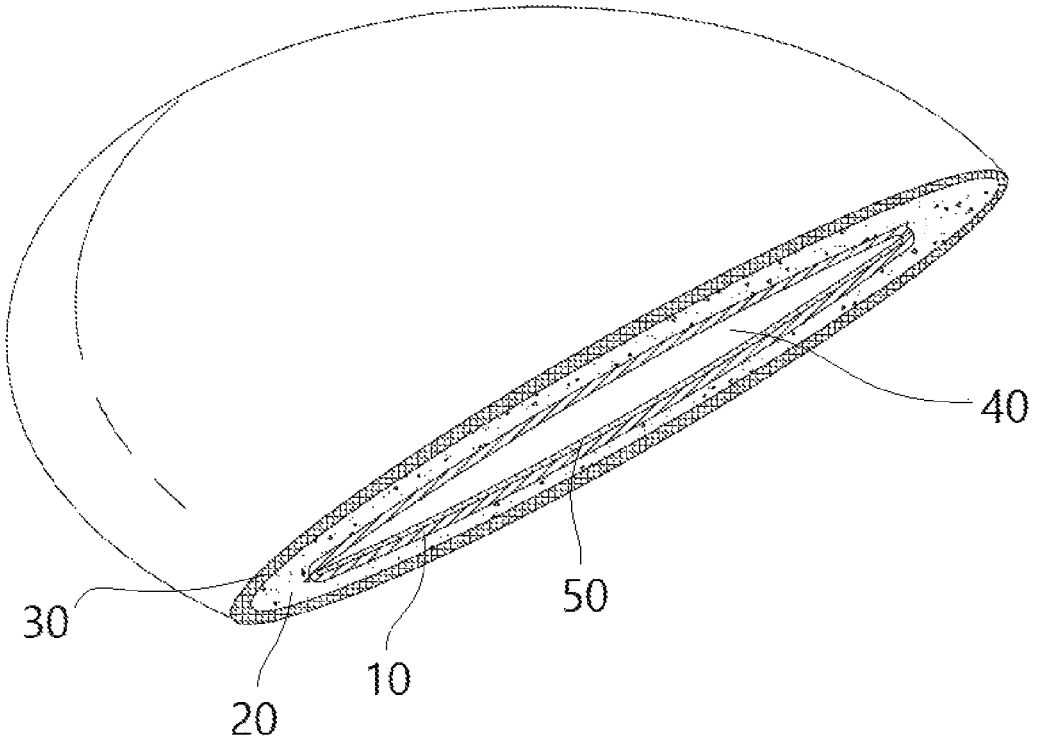
FIG. 2 is a partial cross-sectional view of an exemplary embodiment of the cosmetic puff using the membrane film according to the present invention.
Figure 3:
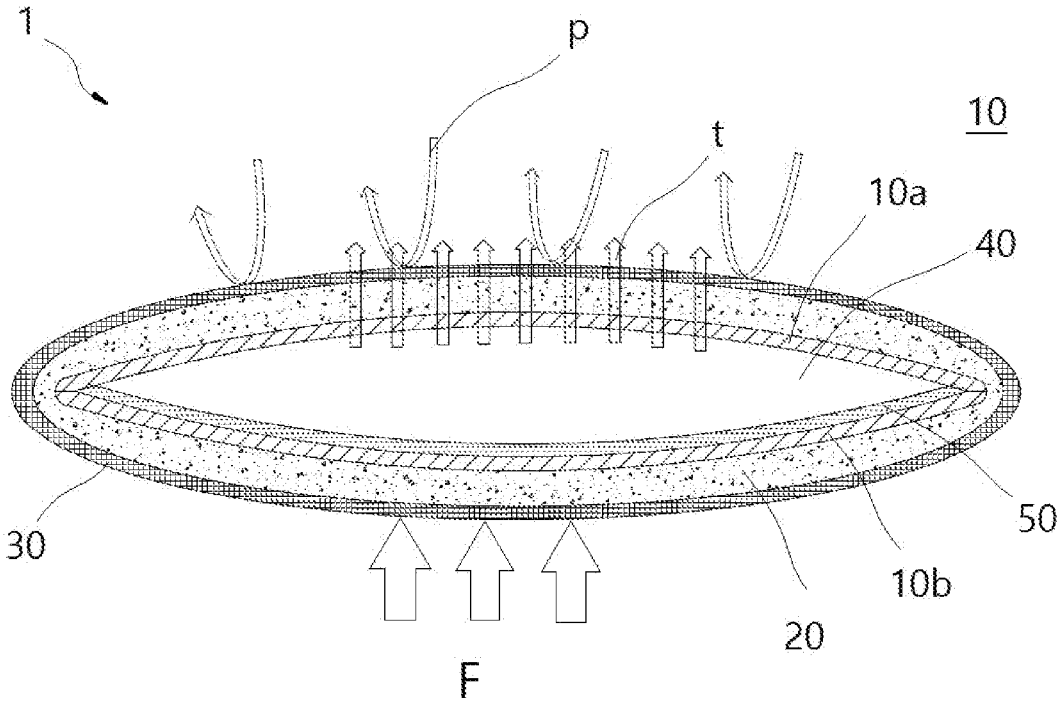
FIG. 3 is a perspective view of an exemplary embodiment of the cosmetic puff using the membrane film according to the present invention illustrating that the liquid cosmetic material of the storage part is discharged to the outside by pressurization force, and penetration of bacteria of the outside is blocked.
Figure 4:
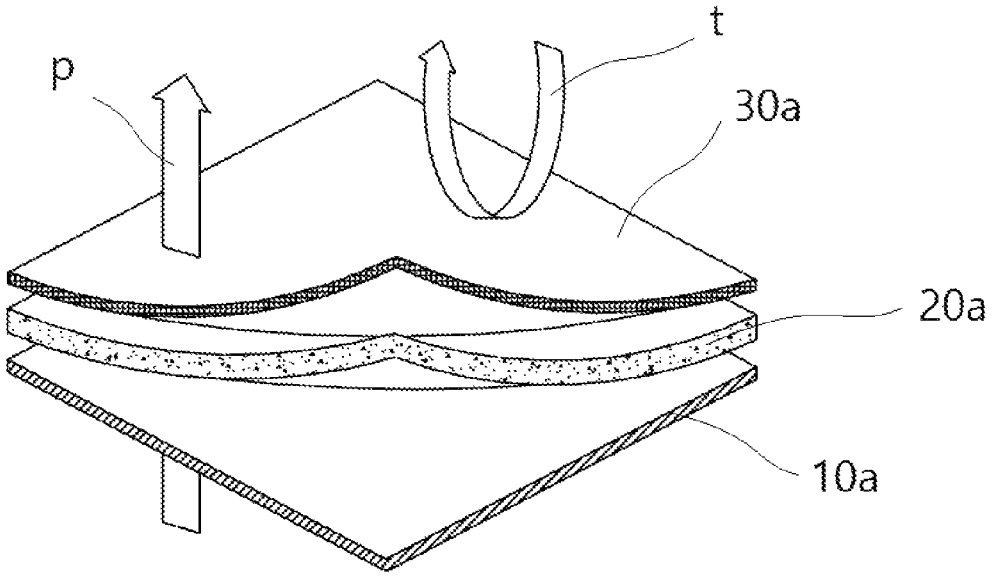
FIG. 4 is a drawing showing a coupling state of an inner skin top surface, an upper cushion material and an upper outer skin formed of the membrane film of FIG. 3, passing of the cosmetic material, and penetration blocking of the bacteria as a perspective view.

FIG. 1, as a perspective view showing a cosmetic puff using a membrane film according to the present invention, is a drawing briefly showing a state that the outer skin is moistened as the liquid cosmetic material of the storage part is discharged to the outside, FIG. 2 is a partial cross-sectional view of an exemplary embodiment of the cosmetic puff using the membrane film according to the present invention, FIG. 3 is a perspective view of an exemplary embodiment of the cosmetic puff using the membrane film according to the present invention illustrating that the liquid cosmetic material of the storage part is discharged to the outside by pressurization force, and penetration of bacteria of the outside is blocked, FIG. 4 is a drawing showing a coupling state of an inner skin top surface, an upper cushion material and an upper outer skin formed of the membrane film of FIG. 3, passing of the cosmetic material, and penetration blocking of the bacteria as a perspective view, (a), (b) and (c) of FIG. 5 are cross-sectional views exemplifying an exemplary embodiment and other embodiments of the cosmetic puff using the membrane film according to the present invention, and FIG. 6 is a production flow chart of the cosmetic puff using the membrane film according to the present invention.

As illustrated in FIG. 1 to FIG. 4, and (a) of FIG. 5, a cosmetic puff 1 using a membrane film according to an exemplary embodiment of the present invention includes an inner skin 10 of which at least one surface forms a liquid cosmetic material storage part made of the membrane film, a porous cushion material 20 which entirely or partially covers the outer surface of the inner skin 10, an outer skin 30 which covers the inner skin 10 or the cushion material 20 to block penetration of external bacteria, a liquid cosmetic material 40 which is stored in the liquid cosmetic material storage part, and a coating film 50 which is coated on the inner side of the inner skin 10.

The inner skin 10 is formed such that the inner skin 10 not only enables the liquid cosmetic material to be stored, but also discharges the stored liquid cosmetic material to the outer skin by a predetermined pressurization force F. The inner skin 10 is formed in a round and flat pocket shape such that the inner skin 10 stores a liquid cosmetic material such as cosmetic water or the like, and the inner skin 10 may be divided into the inner skin top surface 10*a* and the inner skin bottom surface 10*b*. At this time, at least one surface of the inner skin corresponding to a side of the inner skin brought into contact with the facial skin, i.e., the inner skin top surface 10*a* is formed of the membrane film.

The at least one surface of the inner skin 10 is formed of the membrane film such that the stored liquid cosmetic material is discharged to the outside through the membrane film by a predetermined pressurization force F. Of course, both the inner skin top surface 10*a* and the inner skin bottom surface 10*b* may be formed of the membrane film.

The membrane film is made of a hydrophilic material or a hydrophobic material, and the materials are not particularly limited if the membrane film is made of materials through which the liquid cosmetic material can selectively pass.

At this time, examples of the hydrophilic material, as the hydrophilic material for a polymer membrane, may include regenerated cellulose, nitrocellulose, cellulose acetate, polyvinyl alcohol, polyamide, and so on. Examples of the hydrophilic material, as the hydrophilic material for a ceramic membrane, may include glass, aluminum oxide (alumina), and so on.

The membrane film formed of such hydrophilic material has a thickness of 0.01 to 0.24 mm, preferably 0.12 mm, and has an air permeability of 0.1 to 1.2 cfm, preferably 0.6 cfm (cubic feet per minute).

Further, examples of the hydrophobic material may include polyethylene, polysulfone, polystyrene, polypropylene, polyethylene terephthalate (PET), polyvinylidene fluoride (PVDF), polytetrafluoroethylene (PTFE), polyvinyl chloride, polyester, acetate, triacetate, polymethyl methacrylate (PMMA), nylon, and so on.

The membrane film formed of such hydrophobic material has a thickness of 0.001 to 0.02 mm, preferably 0.01 mm, and has an air permeability of 0.1 to 1.4 cfm, preferably 0.7 cfm (cubic feet per minute).

On the other hand, the hydrophobic material may be subjected to a hydrophilic treatment process by introducing a hydrophilic group such as a sulfone group, a carbonyl group or the like in the hydrophobic material, wherein examples of a method for giving hydrophilicity to the hydrophobic material may include a method for physically adsorbing or chemically coating a hydrophilic polymer layer, a method for introducing a hydrophilic segment in a separation membrane using radiation or low temperature plasma, a method for adding an inorganic material in resin, a method for blending a hydrophilic polymer or an amphoteric polymer in a cast solution, and so one.

Since diameters of numerous pores of the membrane film, i.e., pore sizes thereof are approximately 0.025 to 0.2 μm, a liquid cosmetic material having pore sizes smaller than 0.025 to 0.2 μm may be discharged to the outside of the puff through the membrane film merely by pressurization of a user. Further, since a solid makeup cosmetic material coated on an outer portion of the puff or a makeup cosmetic material, bacteria or the like deposited on the puff has pore sizes has pore sizes larger than 0.025 to 0.2 μm, the solid makeup cosmetic material, or the makeup cosmetic material, bacteria or the like is prevented from being penetrated into the puff, preferably the liquid cosmetic material storage part. The membrane film prevents the makeup cosmetic material, bacteria or the like from being penetrated even into the liquid cosmetic material storage part although the makeup cosmetic material, bacteria or the like is penetrated into the outer skin depending on outer skin material to be used by forming the membrane film having such relatively small pore sizes on an inner side of the outer skin.

Further, the inner skin bottom surface 10*b*, as a surface corresponding to a surface which is pressurized by one's fingers, is obtained by forming the coating film 50 on an inner side of the inner skin bottom surface 10*b* to perform a waterproof coating treatment on the inner skin bottom surface 10*b*, or forming the inner skin bottom surface 10*b* itself of a water proof material such that the stored liquid cosmetic material is not discharged towards the fingers.

At this time, the inner skin top surface 10*a* and the inner skin bottom surface 10*b* may be sealed through thermal fusion or bonding.

The cushion material 20, as a porous material, may be divided into an upper cushion material 20*a* and a lower cushion material 20*b*, and may be provided to cover the entire outer side of the inner skin 10 or the inner skin top surface 10*a*. At this time, the cushion material is provided to improve applicability of the makeup cosmetic material to the skin and increase adhesion of the makeup cosmetic material to the skin by transferring the liquid cosmetic material passing through the membrane film to the outer skin, and enabling elastic force of the cushion material to coat the outer skin with an appropriate amount of the makeup cosmetic material at the same time.

Although the cushion material (20; 20*a*,20*b*) is illustrated as an element in the present invention, it goes without saying that the cushion material may be omitted depending on material of the outer skin.

The outer skin 30, as material which blocks penetration of the makeup cosmetic material, bacteria and others from the outside while enabling the liquid cosmetic material to pass through the material, may be divided into the upper outer skin 30*a* and a lower outer skin 30*b*, and may be provided to cover an outer surface of the inner skin 10 or the cushion material 20.

It is preferable that the outer skin 30 is made of Rubycell material having excellent antibacterial activity formed of a synthetic resin such as polyurethane or made of NBR (Nitrile Butadiene Rubber) material having excellent cushioning effect and impact absorption formed in a continuous porous body and having oil resistance as excellent resistance to oil.

Since such material for the outer skin enables the liquid cosmetic material discharged from the inside of the outer skin to be discharged to the outside of the outer skin through the outer skin, the outer skin moistened by the liquid cosmetic material helps the makeup cosmetic material coated on the outer skin to be coated on the facial skin more evenly and closely adhesively and enables bacteria and so on penetrated from the outside to be primarily blocked.

Examples of the material for the outer skin may include varieties of latex sponges, a flocking (polyurethane flocked foam) sponge, a PVA (polyvinyl alcohol) sponge, and a porous body made of a latex, as material, which is formed by mixing styrene butadiene rubber (SBR) and natural rubber (NR) raw materials, or NBR, SBR and NR raw materials.

The liquid cosmetic material 40 stored in the liquid cosmetic material storage part may include an essence or cosmetic water which is capable of giving a moisturizing effect to the skin by supplying moisture and nutrition to the skin, vegetable oil or animal oil which is pure to the skin, or mixtures thereof. Since such liquid cosmetic material 40 is maintained in a gelation state by intermolecular cohesiveness due to a thickener such as xanthan gum or carbomer, the liquid cosmetic material 40 is not discharged to the outside of the membrane film if the liquid cosmetic material 40 is not pressurized by a predetermined pressure F.

The liquid cosmetic material discharged to the outside of the outer skin supplies moisture and others to the facial skin when the makeup cosmetic material is used.

The coating film 50 which is coated on an inner surface of the inner skin 10 having the liquid cosmetic material discharged therethrough is coated on an inner surface of the inner skin bottom surface 10*b* corresponding to a surface on which pressurizing one's fingers are positioned. This is for preventing the stored liquid cosmetic material 40 from being discharged to a side at which the pressurizing one's fingers are positioned.

At this time, coating solutions prepared by dissolving one or more coating agents selected from polyvinylpyrrolidone, polyvinyl alcohol, acrylates/acrylamide copolymer, rosin, wax, silicone resins and so on into a solvent such as purified water, alcohol, isododecane, mineral oil or the like may be used as a coating solution. It goes without saying that the coating solution is not limited to the coating solutions.

Arrows p in FIG. 3 and FIG. 4 indicate that bacteria and others cannot penetrate, and arrows t indicate that the stored liquid cosmetic material 40 can be discharged to the outside of the membrane film, the cushion material and the outer skin by pressurization force F.

A cosmetic puff 1 using the membrane film according to other exemplary embodiment of the present invention includes the liquid cosmetic material storage part which is formed by the inner skin top surface 10*a* formed of the membrane film and the lower outer skin 30*b* coated with the coating film 50 as illustrated in (b) of FIG. 5. Further, the cosmetic puff 1 using the membrane film according to other exemplary embodiment of the present invention may have a structure that the porous upper cushion material 20*a* covers the outer surface of the inner skin top surface 10*a*, the upper outer skin 30*a* covers the upper cushion material 20*a*, and the liquid cosmetic material 40 is stored in the liquid cosmetic material storage part.

Further, the cosmetic puff 1 using the membrane film according to other exemplary embodiment of the present invention may have a structure as illustrated in (c) of FIG. 5 that the liquid cosmetic material storage part is formed by the inner skin top surface 10*a* formed of the membrane film and the lower outer skin 30*b* coated with the coating film 50, the upper outer skin 30*a* covers the outer surface of the inner skin top surface 10*a*, and the liquid cosmetic material 40 is stored in the liquid cosmetic material storage part.

Further, as illustrated in FIG. 6, a method for producing a cosmetic puff 1 using a membrane film according to an exemplary embodiment of the present invention is as follows.

(S1) Step of forming a liquid cosmetic material storage part of which an inner skin 10 has at least one surface thereof made of a membrane film The liquid cosmetic material storage part is formed of the inner skin 10 having a round and flat pocket shape to store a liquid cosmetic material such as cosmetic water or the like, and the inner skin top surface 10*a* corresponding to a surface of the inner skin 10 brought into contact with the facial skin is formed of the membrane film.

(S2) filling a liquid cosmetic material into the liquid cosmetic storage part

The liquid cosmetic material such as the cosmetic water or the like is injected into the liquid cosmetic material storage part made of the inner skin top surface 10*a* formed of the membrane film and the inner skin bottom surface 10*b* treated with a waterproof coating through a syringe or other injection means. An injection portion of the liquid cosmetic material storage part is formed of a rubber material having excellent elastic restoring force or sealed by other various publicly-known methods to prevent the liquid cosmetic material within the liquid cosmetic material storage part from being leaked through the injection portion after the liquid cosmetic material is injected into the liquid cosmetic material storage part.

(S3) covering the entire outer surface of the inner skin 10 or the inner skin top surface 10*a* with a porous cushion material 20

The entire outer surface of the inner skin 10 or the inner skin top surface 10*a* is covered with the cushion material 20 formed of a porous material to increase adhesion of the makeup cosmetic material to the skin by transferring the liquid cosmetic material passing through the membrane film to the outer skin and enabling elastic force of the cushion material to coat the outer skin with an appropriate amount of the makeup cosmetic material at the same time, thereby improving applicability of the makeup cosmetic material to the skin.

(S4) covering the outer surface of the inner skin 10 or the cushion material 20 with an outer skin 30

The outer surface of the inner skin 10 or the cushion material 20 is covered with the outer skin 30 made of material through which the liquid cosmetic material passes, and which blocks penetration of external bacteria.

Herein, since the outer skin made of Rubycell material or NBR (Nitrile Butadiene Rubber) material has the liquid cosmetic material held therein by passing the liquid cosmetic material discharged from the inside of the liquid cosmetic material storage part to the outside thereof through the inner skin and the cushion material, the outer skin moistened by the liquid cosmetic material helps the makeup cosmetic material coated on the outer skin to be coated on the facial skin more evenly and closely adhesively and blocks bacteria and others penetrated from the outside.

Herein, although a sectional view of the cosmetic puff is illustrated in a circular shape, the cosmetic puff is not limited to the circular shape, but the cosmetic puff may be produced in various shapes such as rectangular, triangular, polygonal and oval shapes in accordance with use or taste.

Further, the membrane film in the cosmetic puff according to the present invention is illustrated such that the membrane film forms the entire inner skin or the entire inner skin top surface, the membrane film is not limited thereto. It goes without saying that the membrane film may be provided only in a certain range of the inner skin top surface.

Although exemplary embodiments of the present invention have been described in detail in the above description, the scope of the present invention is not limited thereto, and various modified or improved forms of those skilled in the art using basic concepts of the present invention defining the following claim also belongs to the scope of the present invention.

What is claimed is:

1. A cosmetic puff produced using a membrane film, the cosmetic puff comprising:

an inner skin of which at least one surface forms a liquid cosmetic material storage part made of a membrane film;

a porous cushion material which entirely or partially covers the outer surface of the inner skin;

an outer skin which covers the inner skin or the cushion material to block penetration of an external makeup cosmetic material or external bacteria;

a liquid cosmetic material which is stored in the liquid cosmetic material storage part; and a coating film which is coated on a portion of the inner side of the inner skin.

2. The cosmetic puff of claim 1, wherein the inner skin is formed to discharge a stored liquid cosmetic material to the outside through the membrane film by a predetermined pressurization force F.

3. The cosmetic puff of claim 1, wherein the membrane film is made of a hydrophilic material or a hydrophobic material.

4. The cosmetic puff of claim 1, wherein the membrane film includes any one selected from regenerated cellulose, nitrocellulose, cellulose acetate, polyvinyl alcohol, polyamide, glass and aluminum oxide as the hydrophilic material.

5. The cosmetic puff of claim 4, wherein the membrane film made of the hydrophilic material has a thickness of 0.01 to 0.24 mm.

6. The cosmetic puff of claim 4, wherein the membrane film made of the hydrophilic material has an air permeability of 0.1 to 1.2 cfm.

7. The cosmetic puff of claim 1, wherein the membrane film includes any one selected from polyethylene, polysulfone, polystyrene, polypropylene, polyethylene terephthalate (PET), polyvinylidene fluoride (PVDF), polytetrafluoroethylene (PTFE), polyvinyl chloride, polyester, acetate, triacetate, polymethyl methacrylate (PMMA), and nylon as the hydrophobic material.

8. The cosmetic puff of claim 7, wherein the membrane film made of the hydrophobic material has a thickness of 0.001 to 0.02 mm.

9. The cosmetic puff of claim 7, wherein the membrane film made of the hydrophobic material has an air permeability of 0.1 to 1.4 cfm.

10. The cosmetic puff of claim 1, wherein the membrane film has a pore size of 0.025 to 0.2 μm.

11. The cosmetic puff of claim 1, wherein the inner skin is divided into an inner skin top surface and an inner skin bottom surface, the inner skin top surface is formed of a membrane film, and the inner skin bottom surface, as a surface corresponding to a surface which is able to be pressurized by one's fingers, is obtained by forming the coating film on an inner surface of the inner skin bottom surface to perform a waterproof coating treatment on the inner skin bottom surface, or forming the inner skin bottom surface itself of a water proof material such that the stored liquid cosmetic material is not discharged towards the fingers.

12. The cosmetic puff of claim 1, wherein the outer skin is made of Rubycell material or NBR (Nitrile Butadiene Rubber) material through which the liquid cosmetic material passes, and which blocks penetration of the makeup cosmetic material or bacteria from the outside.

13. The cosmetic puff of claim 1, wherein the liquid cosmetic material stored in the liquid cosmetic material storage part includes an essence or cosmetic water which is capable of giving a moisturizing effect to the skin by supplying moisture and nutrition to the skin, vegetable oil, animal oil, or mixtures thereof.

14. A cosmetic puff produced using a membrane film, the cosmetic puff including:

an inner skin top surface formed of the membrane film and a lower outer skin coated with a coating film;

a liquid cosmetic material storage part formed by the inner skin top surface and the lower outer skin;

a porous upper cushion material which covers an outer surface of the inner skin top surface;

an upper outer skin which covers the upper cushion material; and a liquid cosmetic material which is stored in the liquid cosmetic material storage part.

15. A method for producing a cosmetic puff using a membrane film, the method comprising the steps of:

forming a liquid cosmetic material storage part of which an inner skin has at least one surface thereof made of a membrane film;

filling a liquid cosmetic material into the liquid cosmetic storage part;

covering an entire outer surface of the inner skin or the inner skin top surface with a porous cushion material; and covering the outer surface of the inner skin or the cushion material with the outer skin.

16. The method of claim 15, wherein the membrane film of the inner skin discharges the stored liquid cosmetic material to the outside by the predetermined pressurization force F, and the outer skin has the liquid cosmetic material passed therethrough, and blocks penetration of the makeup cosmetic material or bacteria from the outside.

* * * * *